US005967236A

United States Patent [19]

Parker

[11] Patent Number: 5,967,236

[45] **Date of Patent: *Oct. 19, 1999**

[54] SPILL CONTROL PLUG AND METHOD

[75] Inventor: Robert Michael Parker, Eunice, N.Mex.

[73] Assignee: Texaco Inc., White Plains, N.Y.

[ * ] Notice: This patent is subject to a terminal disclaimer.

[21] Appl. No.: 08/834,326

[22] Filed: Sep. 23, 1994

[51] Int. Cl.[6] ..... E21B 19/00

[52] U.S. Cl. ..... 166/386; 166/77.51; 294/86.1

[58] Field of Search ..... 166/75.11, 77.51, 166/77.52, 81.1, 85.1, 386; 175/161, 218, 203; 294/86.1, 86.12, 86.24

[56] References Cited

U.S. PATENT DOCUMENTS

| | | | |
|---|---|---|---|
| 3,193,015 | 7/1965 | Loomis | 294/86.1 X |
| 4,105,189 | 8/1978 | Beall | 166/75.11 X |
| 5,645,131 | 7/1997 | Trevisani | 166/77.52 X |

*Primary Examiner*—William Neuder
*Attorney, Agent, or Firm*—Henry H. Gibson; WIlliam J. Beard

[57] ABSTRACT

A spill control plug is arranged to be selectively inserted into and removed from tubing while the tubing is being tripped into or out of a well to contain the fluids therein.

6 Claims, 1 Drawing Sheet

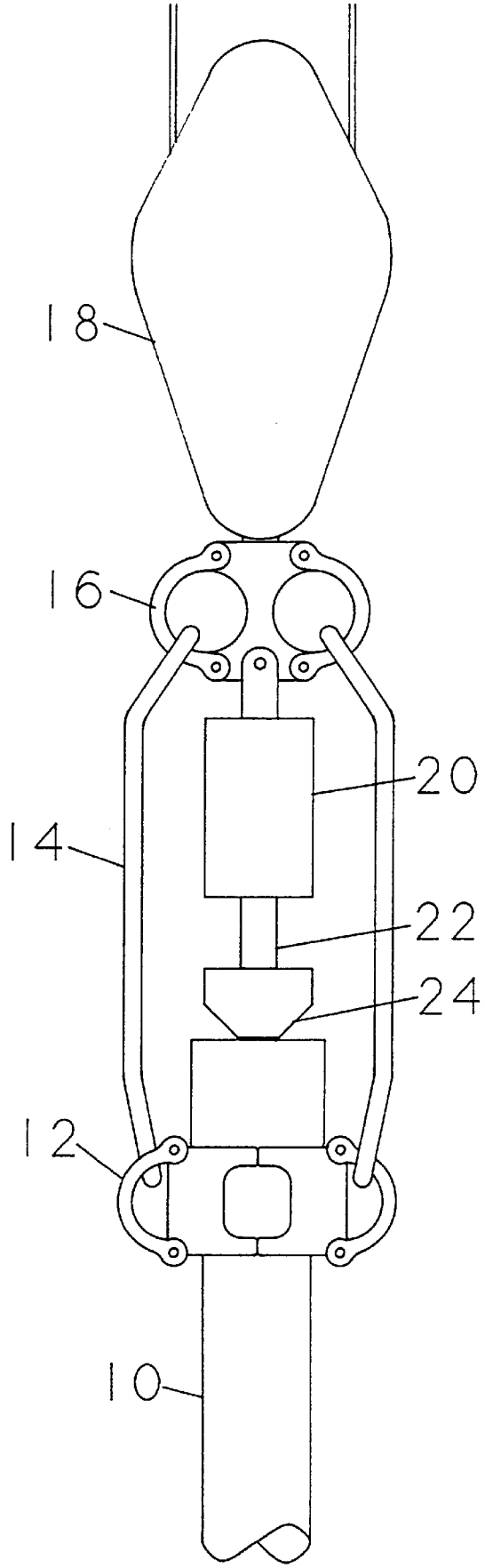
18
16
20
14
22
24
12
10

SPILL CONTROL PLUG AND METHOD

BACKGROUND OF THE INVENTION

1. The Field of the Invention

The present invention concerns a method and apparatus to reduce the amount of fluids that are released into the environment during well servicing operations.

2. The Prior Art

During servicing operations on wells that have very high fluid levels the probability of fluid being displaced out of the wellborne is great. Catch pans have been designed and placed beneath the tubing slips in order to contain as much of the fluids as is possible. However, when the tubing is run into the well large volumes of fluid often rise up and are ejected from the tubing operations, which may be as high as 65 feet above the surfacing floor. These fluids, when released from such height, have a tendency to be blown away from the floor and rain down upon the unit, the location and the servicing personnel.

SUMMARY OF THE INVENTION

The present invention is designed to place an efficient reusable plug in the tubing opening and thereby reduce or substantially eliminate fluids being ejected from the tubing above the surface floor as the tubing is handled. This will reduce the amount of environmental contamination and increase the safety for the well servicing personnel.

BRIEF DESCRIPTION OF THE DRAWING

The present invention will now be described, by way of example, with reference to the accompanying drawings in which the single FIGURE is a side elevation of the present invention.

DETAILED DESCRIPTION OF THE PREFERRED EMBODIMENT

Turning now to the FIGURE, the tubing 10 is shown engaged by tubing elevators 12 suspended by elevator bails 14 from the travelling block swivel 16 which, in turn, is suspended from the travelling block 18. The present invention comprises an air cylinder 20 which is suspended from the travelling block swivel 16 with a piston rod 22 extending therefrom with a plug 24 on the lower end thereof. The air cylinder is powered by the unit air supply (not shown) for extension and retraction. Alternatively, the air cylinder could be spring loaded for self retraction.

In order to operate this spill control plug assembly, it is on the travelling block swivel in place of the conventional rod elevator hook. The air supply for the spill control plug assembly is obtained from the well servicing unit. When actuated, the piston rod of the cylinder will extend to press into place a plug (design of which may vary) into the tubing opening. The exit of fluid from the tubing is therefor blocked.

In operation, if fluids are being released while tripping the tubing out of the hole, the plug 24 can be guided into place by the floor hands before being actuated by the unit operator. The tubing 10 is then pulled up to the required level and the slips (not shown) are set. The pressure on the plug is released by the unit operator and the cylinder retracts the plug. The tubing is unscrewed by the tong and picked up and placed. The elevators 12 are lowered for the next pulling operation. It may be desirable to provide mechanical guidance means to assist in the proper positioning of the assembly.

If fluids are being released while tripping the tubing into the hole, the connection can be made and then the plug 24 guided into place by the derrick man while being actuated by the unit operator. The tubing is lowered to the required level and the slips are set. Pressure will build up in the tubing during this operation and, for this reason, it may be desirable to provide pressure monitoring and/or relieving means (not shown) in conjunction with the plug. The pressure on the plug is released with care by the unit operator and the cylinder retracts the plug. The elevators are then unlatched and raised to catch the next joint.

The use of the subject spill control plug may slow pipe running somewhat into the derrick man having to contend with the cylinder which extends below the blocks. With practice the derrick man should be able to make catches and releases in a timely fashion.

In practice, the fluid level in the tubing actually falls as the tubing is raised. Therefore the potential for fluid release while tripping out of the hole is reduced by two factors. First the tubing opening is elevated above ground level and second, the displacement in the wellbore is reduced. However, once the "double" is set in slips, the well will begin to refill the tubing. As envisioned, the plug would be actuated after the tongs have been disengaged. Allowing the partly filled "double" to be removed, much as a soda straw can be removed from a soft drink with fluid in it when you hold the thumb over the top of the opening. The lower tubing end can then be directed to a containment area under the servicing floor and the plug can be deactivated releasing the fluid into the containment area.

The greatest release of fluid occurs when the tubing is tripped down the hole. Activating the plug after the tongs have been disengaged, the operator would lower the tubing into the well allowing sufficient time for the fluid to be displaced from the annulus to the containment area. After the slips are set, the flow from the annulus would be judged by the operator before releasing the plug. The tools on the end of the tubing would be a significant factor on the amount of time it would take for the pressure to equalize. It has been found desirable, but not essential, to have bearing means (not shown) to facilitate pipe rotation permitting ready access to pressure relieving means (also not shown). The release would occur at floor level much improving the chances for recovering the fluid.

Three contingencies exists. If it becomes necessary to activate the plug while the tubing is being rotated by the tongs, a bearing could be placed on the plug itself to facilitate rotation. A pressure release valve or hose could be fitted on the plug to allow release of the pressure to a containment area while tripping downhole. Various lengths of extensions will have to be made for the stringer to compensate various lengths of elevator bails. This would not impose a large problem and three lengths would probably be sufficient. A larger version of this device might be useful in drilling rigs during tripping off operations since it would help to contain the drilling fluids.

The present invention may be subject to many modifications and changes without departing from the spirit or essential characteristics thereof. The present embodiment should therefore be considered in all respects as illustrative and not restrictive to the scope of the invention as defined by the appended claims.

I claim:

1. A method for controlling fluid spills during well tripping operations comprising the steps of:

providing a travelling block assembly with a controllable plug assembly;

selectively actuating said plug assembly to insert and remove a plug into and from a tubing being tripped from a well whereby the fluid contained in said tubing is contained against spillage.

2. The method according to claim 1 further comprising:

providing means to monitor pressures within the pipe and to control release of said pressure.

3. A spill control plug assembly for use during well tripping operations, comprising:

a plug assembly adapted to be suspended from a travelling block, said plug assembly having a plug member and means to move said plug member axially of a tube being carried by said travelling block assembly whereby selective insertion of said plug member into and removal from the tubing controls the discharge of fluid therefrom.

4. A spill control plug assembly according to claim 3 wherein said means to move said plug member is an air cylinder.

5. A spill control plug assembly according to claim 4 wherein said air cylinder has spring retraction means.

6. A spill control plug assembly according to claim 3 wherein said plug member is molded with an outer configuration suitable for reception into a drill pipe.

* * * * *